United States Patent [19]

Yunan

[11] 4,369,688

[45] Jan. 25, 1983

[54] METHOD AND APPARATUS FOR PRODUCING A DETONATING CORD

[75] Inventor: Malak E. Yunan, Boonton Township, Morris County, N.J.

[73] Assignee: E. I. Du Pont de Nemours and Company, Wilmington, Del.

[21] Appl. No.: 151,243

[22] Filed: May 19, 1980

Related U.S. Application Data

[60] Division of Ser. No. 842,096, Oct. 17, 1977, Pat. No. 4,232,606, which is a continuation-in-part of Ser. No. 762,824, Jan. 26, 1977, abandoned.

[51] Int. Cl.[3] ..... C06B 21/00

[52] U.S. Cl. ..... 86/1 R; 102/275.8; 264/3 R; 264/171; 264/174; 425/131.1; 425/113; 425/114

[58] Field of Search ..... 264/171, 174; 425/131.1, 113, 114; 86/1 R, 22; 102/275.1, 275.5, 275.8

[56] References Cited

U.S. PATENT DOCUMENTS

| | | | |
|---|---|---|---|
| 2,687,553 | 8/1954 | Colombo | 18/13 |
| 3,249,666 | 5/1966 | French | 264/174 |
| 3,606,632 | 9/1971 | Bunish | 425/113 |
| 3,683,742 | 8/1972 | Rohde | 86/1 R |

FOREIGN PATENT DOCUMENTS 1416128 12/1975 United Kingdom .

*Primary Examiner*—Paul R. Michl
*Attorney, Agent, or Firm*—D. C. Ascani

[57] ABSTRACT

An improved low-energy detonating cord, which is light-weight, flexible, strong, and non-conductive, detonates at high velocity, and is readily adapted to high-speed continuous manufacturing techniques, has a continuous solid core of a deformable bonded detonating explosive composition comprising a crystalline high explosive compound, preferably superfine PETN, admixed with a binding agent, the crystalline explosive loading being about from 0.5 to 10 grains per foot (0.1 to 2 grams per meter) of length; and, enclosing the core, a protective plastic sheath, e.g., about 0.005–0.075 inch (0.127–1.905 mm) thick, no metal or woven textile layers being present around the core or sheath. Perferably, one or more continuous strands of reinforcing yarn, e.g., running substantially parallel to the core's longitudinal axis, are located between the core and the plastic sheath, or in or around the sheath. A preferred cord can be made by drawing strands of yarn under tension in the form of a moving cage of substantially parallel strands, allowing the moving cage to engrain a bonded explosive core within it and thereby form a conveyor for the core, and applying a layer of plastic material around the cage while effecting substantially no change in the diameter of the exposive core after its entrainment within the cage.

11 Claims, 5 Drawing Figures

METHOD AND APPARATUS FOR PRODUCING A DETONATING CORD

This application is a division of application Ser. No. 842,096, filed Oct. 17, 1977, now U.S. Pat. No. 4,232,606, which application was a continuation-in-part of my application Ser. No. 762,824, filed Jan. 26, 1977, now abandoned.

BACKGROUND OF THE INVENTION

1. Field of the Invention

The present invention relates to an improved explosive connecting cord for use in transmitting a detonation wave to an explosive charge, and more particularly to an explosive connecting cord of the type known as "low-energy detonating cord". The invention relates also to a method and apparatus for manufacturing detonating cord.

2. Description of the Prior Art

The hazards associated with the use of electrical initiation systems for detonating explosive charges in mining operations, i.e., the hazards of premature initiation by stray or extraneous electricity from such sources as lightning, static, galvanic action, stray currents, radio transmitters, and transmission lines, are well-recognized. For this reason, non-electric initiation through the use of a suitable detonating fuse or cord has been looked upon as a widely respected alternative. A typical high-energy detonating cord has a uniform detonation velocity of about 6000 meters per second and comprises a core of 30–50 grains per foot (6 to 10 grams per meter) of pentaerythritol tetranitrate (PETN) covered with various combinations of materials, such as textiles, waterproofing materials, plastics, etc. However, the magnitude of the noise produced when a cord having such PETN core loadings is detonated on the surface of the earth, as in trunklines, often is unacceptable in blasting operations in developed areas. Also, the brisance (shattering power) of such a cord may be sufficiently high that the detonation impulse can be transmitted laterally to an adjacent section of the cord or to a mass of explosive which, for example, the cord contacts along its length. In the latter situation, the cord cannot be used to initiate an explosive charge in a borehole at the bottom (the "bottomhole priming" technique), as is sometimes desired.

Low-energy detonating cord (LEDC) was developed to overcome the problems of noise and high brisance associated with the above-described 30–50 grains per foot cord. LEDC has an explosive core loading of only about 0.1 to 10 grains per linear foot (0.02 to 2 grams per meter) of cord length, and often only about 2 grains per foot (0.4 gram per meter). This cord is characterized by low brisance and the production of little noise, and therefore can be used as a trunkline in cases where noise has to be kept to a minimum, and as a downline for the bottomhole priming of an explosive charge.

U.S. Pat. No. 2,982,210 describes a low-energy detonating cord comprised of a continuous core of a granular cap-sensitive high explosive such as PETN of such diameter as to contain from 0.1 to 2 grains per foot (0.02 to 0.4 g/m) of explosive, encased in a metal sheath, which may be covered with a fabric countering or a coating of plastic. The metal sheath is reported to be essential for the propagation of detonation in explosive cores of such low loadings.

Because LEDC having a metal sheath is not amenable to continuous manufacture in unlimited length, and because this cord is electrically conductive along its length owing to the conductivity of the metal sheath, attempts have been made to eliminate the metal sheath by resorting to other expedients to overcome the effect of its absence. Such attempts have not always met with complete success especially with core loadings of about 2 grains per foot (0.4 g/m) or less. For example, it is stated in U.S. Pat. No. 3,125,024 that a uniform detonation velocity can be obtained even without a metal sheath with a granular PETN core in loadings of 1.5 to 10 grains per foot (0.32 to 2 grams per meter) of length provided that the specific surface of the PETN is from about 900 to 3400 square centimeters per gram and the granular core is confined within a woven textile sheath surrounded by a protective and reinforcing covering, i.e., a thermoplastic layer or a series of waterproofing and reinforcing materials including a second textile sheath. However, woven or wound sheathing is relatively expensive to apply, both in terms of the type of equipment required and limitations thereby imposed on cord production rates. Furthermore, even with the high PETN specific surface and the confinement afforded by the woven textile sheath and thermoplastic covering, reliable, high-velocity detonation is not achieved when the PETN core loading is at the lower end of the LEDC range.

British Pat. No. 815,534 and U.S. Pat. No. 3,311,056 describe low-energy detonating cords having an explosive core confined within a polymeric sheath. The British patent describes a cord having a granular core of finely divided explosive in loadings from 2 to 15 grains per foot (0.4 to 3 g/m) confined in a flexible sheath of a thermoplastic polymer, which may be wrapped in woven fabric and wire for strength and abrasion resistance. The detonating cord described in U.S. Pat. No. 3,311,056 is a non-rupturing type of cord by virtue of a thick expandable sheath of elastomeric polyurethane which surrounds the explosive core, the ratio of the amount of explosive in grains per foot to sheath thickness in inches to prevent rupturing being less than 130/1, and preferably from about 10/1 to 100/1 (ratio of the amount of explosive in grams per meter to sheath thickness in centimeters less than 11/1, and preferably from about 0.8/1 to 8/1). Explosive core loadings of 1 to 400, preferably 2 to 100, grains per foot (0.2 to 80, preferably 0.4 to 20, grams per meter) are described, and thus the cord encompasses high-energy as well as low-energy detonating cords. The 2–20 grains per foot (0.4–4 grams per meter) cord claimed has a PETN core confined in a lead sheath. Moreover, although explosive cores made of self-supporting compositions of the type used in sheet explosives, e.g., those shown in U.S. Pat. Nos. 2,992,087 and 2,999,743, are disclosed, the low-energy detonating cores having loadings of 5 and 10 grains per foot (1 and 2 grams per meter) have granular explosive cores, confining lead sheaths, and low ratios of explosive loading to polyurethane sheath thickness (48 and 20 grains per foot per inch, 4 and 1.7 grams per meter per centimeter, of sheath thickness).

U.S. Pat. No. 3,384,688 describes the preparation of a textile-sheathed cord having enhanced sensitivity to side initiation and the ability to propagate detonation at lower loading densities by the use of a special finely divided granular PETN core in a loading of 10 grains per linear foot (2 g/m). U.S. Pat. No. 3,382,802 prescribes a maximum particle size of 100 microns, with at least half the particles smaller than 50 microns, for a core of granular primary explosive in low loading, e.g., 5–10 grains per foot (1–2 grams per meter), encased in a sheath of spiral-wound thread-like elements made of metal or thermoplastic, spiral-wound fibrous sheaths, and a thermoplastic outer shell.

As can be seen from the above-discussed patents, heretofore granular explosive cores have been used in detonating cords having core loadings of 10 grains per foot (2 grams per meter) or less. Moreover, metal or heavy textile sheathing generally has been indicated, especially when the loading drops to below 2 grains per foot (0.4 grams per meter). Self-supporting explosive compositions in which a crystalline high explosive compound is admixed with a binding agent can be extruded rapidly in the form of cords and would enable higher cord production rates to be attained as contrasted to production rates attainable with cords having granular cores. Also, bonded explosive compositions have high density and can detonate at a higher velocity for a given diameter when contrasted to lower-density explosives. However, since the common bonded explosive compositions contain less-sensitive materials, such compositions are less sensitive to initiation than totally explosive granular compositions and would not be expected to detonate under all of the same conditions as such granular compositions. Thus, while U.S. Pat. No. 3,311,056 describes certain detonating cords having bonded explosive cores, the low-loading cores therein are granular PETN and lead azide/aluminum, and even these are lead-jacketed. Also, it is known that the cord diameter and explosive loading have to be sufficiently large if self-supporting sheet explosive compositions are to propagate a detonation at uniformly high velocity. The aforementioned U.S. Pat. No. 2,992,087 discloses that a cord made by extruding a nitrocellulose-based PETN sheet explosive to a PETN loading of 20 grains per foot (4 grams per meter) detonates at a velocity of greater than 6400 meters per second; and the aforementioned U.S. Pat. No. 3,311,056 discloses bonded-explosive cores in PETN loadings of 17.5 and 20.0 grains per foot (3.7 and 4 grams per meter). However, cords having bonded-explosive cores in explosive loadings of 10 grains per foot (2 grams per meter) or less have been avoided despite the fact that such loadings have been found operable with granular PETN explosives. U.S. Pat. Nos. 3,338,764, 3,401,215, 3,407,731, and 3,428,502 describe the preparation of detonating cord having an explosive loading of 50 to 200 grains per foot (10 to 40 grams per meter) by the extrusion of a flexible elastomer-bonded explosive composition, preferably around an axially positioned reinforcing yarn or thread. The wrapping of reinforcing yarns or threads around the extruded cord, e.g., as in a braided structure, and the bonding of the yarns to the cord with a latex or liquid polymer is reported to be less desirable than an internally placed reinforcing means.

In the art of manufacturing detonating cord, threads have been used also for the purpose of facilitating the sheathing of powdered explosive cores. For example, U.S. Pat. No. 3,683,742 describes circularly guiding one or more roughened threads through a funnel which feeds dust-like explosive into a sheath continuously manufactured at the lower end of the funnel, the thread(s) being deflected from the funnel's vertical axis and introduced into the sheath together with the explosive. The thread(s) entrain the dust-like explosive and conduct it into the sheath, whereby a granular explosive core is formed around internal thread(s).

British Pat. No. 1,416,128 and Belgian Pat. No. 815,257 describe enclosing a column of dry, pulverulent explosive within a boundary of joined-together axial threads, and drawing the column/thread assembly through a compressing die under a tension exerted on the threads so as to form the core of a detonating fuse. The thus-formed core, in which the threads enwrap and form a sleeve around the explosive, is shown enwrapped with a reinforcing layer of wound textile material, which is coated with plastic for waterproofing.

U.S. Pat. No. 2,687,553 describes the use of longitudinal threads in cord manufacture for the purpose of reinforcing a thermoplastic coating to overcome the latter's elasticity. The resulting cord has an explosive core enclosed in a sheath of thermoplastic material in which strong threads are embedded in a longitudinal direction. The entire periphery of the explosive core is in direct contact with the thermoplastic sheath, and the threads are surrounded by the thermoplastic.

SUMMARY OF THE INVENTION

The present invention provides an improved low-energy detonating cord comprising (a) a continuous solid core of a deformable bonded detonating explosive composition comprising at least about 55 percent by weight of a cap-sensitive crystalline high explosive compound selected from the group consisting of organic polynitrates and polynitramines admixed with a binding agent, the particles of crystalline high explosive compound in the composition having their maximum dimension in the range of about from 0.1 to 50 microns, the average maximum dimension generally being no greater than about 20 microns, and the core containing about from 0.5 to 10 grains of crystalline high explosive compound per foot (0.1 to 2 grams per meter) of length; and (b) enclosing the core, protective sheathing consisting solely of one or more layers of plastic material preferably having a total thickness of about from 0.005 to 0.075 inch (0.127 to 1.905 mm), the plastic material being one which is capable of flowing at a temperature not exceeding the melting point of the crystalline high explosive compound by more than about 75° C., e.g., a material which flows at a temperature not exceeding about 200° C. when the high explosive compound is PETN.

In a preferred cord of the invention, the bonded explosive core is reinforced peripherally by at least one strand of yarn between the core and the plastic sheath, or in or around the sheath, and most preferably the cord contains core-reinforcement means consisting essentially of at least one continuous strand of yarn on the periphery of the core and running substantially parallel to the core's longitudinal axis, the strand(s) having sufficient tensile strength as to prevent the core from necking down to a failure point under forces normally encountered in borehole loading, e.g., to provide the reinforced core with a tensile strength of at least about 10 pounds (4.5 kilograms), and preferably at least about 20 pounds (9 kilograms), to enable it to withstand more unusual forces.

A particularly preferred cord of the invention is one in which the crystalline high explosive compound in the bonded composition is pentaerythritol tetranitrate (PETN), the PETN loading in the core is about from 2 to 10 grains per foot (0.4 to 2 grams per meter) of length, the plastic material is a polyolefin extrudable at a temperature of about 175° C., and at least about four reinforcing strands of a polyamide or polyester yarn are substantially uniformly distributed on the periphery of the core.

The present invention also provides a method of producing a detonating cord comprising (a) forming a mixture of a cap-sensitive crystalline high explosive compound and a binding agent therefor into a continuous solid core, e.g., by extrusion;

(b) drawing strands of yarn under tension sufficient to form a moving cage of substantially parallel longitudinal strands;

(c) allowing the moving cage to entrain the core within it, whereby the cage becomes a conveyor for the core;

(d) applying a layer of soft plastic material around the moving cage, usually after the entrainment of the core therein, while effecting substantially no change in the diameter of the core after its entrainment within the cage; and (e) hardening the plastic material.

In one preferred embodiment of the method, the core is extruded into the continuously moving yarn cage, and the caged core unit, with or without peripheral support, subsequently moves into and through a plastic coating extrusion die wherein the plastic material is formed into a sheath over the caged core unit. In another, the yarn strands and the core are moved separately into a plastic coating extrusion die, and the formation of the cage, entrainment of the core, and formation of the sheath all occur within the confines of the die, either simultaneously or with sheathing following entrainment. In each case, substantially no reduction in the diameter of the core as a result of compression occurs.

Also provided by this invention is an apparatus for producing a detonating core comprising (a) a first extrusion means, for forming a mass of a deformable bonded detonating explosive composition into a continuous solid core;

(b) means for orienting strands of yarn substantially parallel to one another in annular array;

(c) means for drawing the substantially parallel strands under tension sufficient to form them into a moving cage, the strand-orienting means being so positioned with respect to the first extrusion means that the cage internally entrains and conveys the core emanating from the first extrusion means;

(d) a second extrusion means, for applying a soft plastic material in the form of a sheath to a substrate moving therethrough, the second extrusion means being so positioned with respect to the first extrusion means and the strand-orienting means that the caged core moves through the second extrusion means as the substrate for the sheath application with substantially no previous, coincident, or subsequent reduction in core diameter; and (e) means adapted to receive the passage of the sheathed, caged core for hardening the plastic material.

Preferably, the first extrusion means is associated with an extruder chamber which contains an opening for drawing a vacuum, and particle-screening means for excluding oversize foreign particles from the core. The strand-orienting means can be a separate guide plate or a component of the second extrusion means.

BRIEF DESCRIPTION OF THE DRAWING

In the accompanying drawing, which illustrates specific embodiments of the explosive connecting cord, method, and apparatus of the invention.

DETAILED DESCRIPTION

Figure 5:
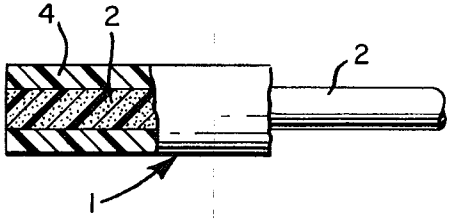

Referring to the section of low-energy detonating cord 1 shown in FIG. 5, the cross-sectioned portion shows a continuous solid core 2 of a deformable bonded detonating explosive composition, e.g., superfine PETN admixed with a binding agent such as plasticized nitrocellulose, the diameter and explosive content of the core being such that about from 0.5 to 10 grains of explosive are present therein per foot (0.1 to 2 grams per meter) of length; and a protective plastic sheath 4, e.g., about from 0.005 to 0.075 inch (0.127 to 1.905 mm) thick, which encloses core 2. In the section of cord shown in FIG. 1, core-reinforcement means 3 consisting of a mass of filaments derived from multi-filament yarns around and in contact with the periphery of core 2 runs parallel to the longitudinal axis of core 2, and sheath 4 encloses core 2 and core-reinforcing filaments 3. In another portion of FIG. 5 sheath 4 has been removed to reveal the peripheral appearance of core 2, and in other portions of FIG. 1, sheath 4 has been removed to reveal the peripheral appearance of filaments 3 on core 2, and filaments 3 removed to reveal the peripheral appearance of core 2.

The low-energy detonating cord of this invention combines the features of a continuous solid (i.e., nonhollow) core of a deformable bonded detonating explosive composition having a low-loading, i.e., 0.5 to 10 grains per foot (0.1 to 2 grams per meter) of length, of crystalline high explosive in a binder therefor, and only a light protective plastic sheath enclosing the core. An additional feature, which is preferred, is longitudinal fiber reinforcement of the core external thereto. It has been found that, contrary to the teachings of the prior art on low-energy detonating cords, a deformable bonded detonating explosive in the form of a cord can be made to propagate a detonation reliably even in loadings below 5–10 grains per foot, at a rate that is useful in blasting operations, e.g., above about 4000 meters per second, without confinement in a metal or woven textile sheath, spirally wound textile, plastic, or metal strands or filaments, or a thick plastic sleeve. It has been found that the just-mentioned confinement is unnecessary if the core is a continuous solid rod of bonded explosive, e.g., a plastic-bonded explosive, containing at least about 55 percent of explosive by weight, and a "superfine" crystalline high explosive component (as will be described later), and reinforcement means for the core is external thereto. In the cord of this invention the explosive particles in the core are held together with a binding agent, e.g., an organic polymeric composition, and this has been found to have a beneficial effect in assuring a uniform, high core density and consequently reliability of detonation, high density being an important consideration particularly in small-diameter, low-loading cords of low brisance. Relative to the bonded core it has been found that, despite the fact that central, internal reinforcement has been reported to be preferred in highloading cords made of self-supporting explosives (U.S. Pat. No. 3,338,764), external reinforcement filaments are important for the proper functioning of low-loading cords made with this type of core. Furthermore, the external reinforcing means, e.g., textile yarns, preferably are longitudinal, running substantially parallel to the cord axis. Such a cord is readily adapted to be made by high-speed continuous manufacturing techniques in contrast to those low-energy detonating cords of the prior art which employ woven or wound textile reinforcement.

The bonded explosive composition which constitutes the explosive core in the cord contains at least one finely divided cap-sensitive crystalline high explosive compound, which can be an organic polynitrate such as PETN or mannitol hexanitrate, or polynitramine such as cyclotrimethylenetrinitramine (RDX) or cyclotetramethylenetetranitramine (HMX). PETN is the most readily available of these compounds and is satisfactory for use under conditions most commonly encountered in blasting, and for these reasons is the preferred crystalline explosive in the bonded explosive core. The crystalline high explosive compound is admixed with a binding agent, which can be a natural or synthetic organic polymer, e.g., the soluble nitrocellulose described in U.S. Pat. No. 2,992,087, or the mixture of an organic rubber and a thermoplastic terpene hydrocarbon resin described in U.S. Pat. No. 2,999,743. The compositions described in these patents can be used for the core of the present cord, and the disclosures of these patents are incorporated herein by reference. Other ingredients may be present in the composition, such as additives used for plasticizing the binder or densifying the composition. Other compositions which can be used are those described in U.S. Pat. Nos. 3,338,764 and 3,428,502, the disclosures of which also are incorporated herein by reference.

The detonating cord of this invention is a "low-energy" cord, i.e., one which, when detonated, produces relatively little noise and exhibits relatively low brisance. Therefore, for a given core composition, the core diameter is such that about from 0.5 to 10, preferably at least about 2, grains of the crystalline high explosive compound are present per foot of core length (0.1 to 2, preferably at least about 0.4, grams per meter). With trunklines containing cores of higher loadings, the noise level is likely to be a problem in certain areas. Below about 0.5 grain per foot (0.1 gram per meter), the reliability of complete propagation of detonation is low unless a high-energy binding agent and/or plasticizer is included in the core composition. With such a composition, e.g., with a composition having a high-viscosity nitrocellulose binder plasticized with trimethylolethane trinitrate, as is described in U.S. Pat. No. 3,943,017, loadings of particulate high explosive in the core as low as about 0.1 grain per foot (0.02 gram per meter) may be feasible. Loadings of about from 2 to 10 grains per foot (0.4 to 2 grams per meter) have been found to be particularly advantageous for downline and trunkline cords. With explosive cores of low loading, as in the present cord, it is important that the crystalline high explosive component be in the "superfine" particle size range, i.e., the maximum dimension of the particles should be in the range of about from 0.1 to 50 microns, and generally the average maximum dimension should be no greater than about 20 microns. Larger explosive particles, extreme variations in particle size, and particulate foreign matter are undesirable inasmuch as they interefere with the uniform propagation of detonation in the core. A preferred explosive for use in the core is one having microholes, as made by the process described in U.S. Pat. No. 3,754,061, the disclosure of which is incorporated herein by reference.

The explosive loading of the core is a function of the crystalline high explosive content of the bonded composition and the core diameter. The crystalline high explosive content can vary, e.g., from about 55 percent up to about 90 percent by weight of the core composition. Although a low explosive content can to some extent be compensated for by a large core diameter, it is more efficient and the propagation of detonation more reliable if, for any given loading, the explosive content is as high as possible, preferably at least about 70 percent by weight of the core composition. For explosive contents in the range of about from 55 to 90 percent, core diameters of about from 0.010 inch (0.025 cm) to 0.060 inch (0.152 cm) will be used to achieve core loadings of 0.5 to 10 grains per foot (0.1 to 2 grams per meter) of core length. A diameter of about 0.027 inch (0.069 cm) is used to achieve the preferred core loading of 2 grains per foot (0.4 gram per meter). The explosive composition also contains about 1 to 10 percent, preferably 2 to 5 percent, by weight of a binding agent, and in addition a plasticizer if needed, to make the composition extrudable, and to provide cohesiveness in the core.

The density of the core varies with the specific particulate explosive and binding agent used and their content, and the nature and amount of other additives, if present. Generally, cores based on the compositions described in the aforementioned U.S. Pat. Nos. 2,992,087 and 2,999,743 will have a density of about 1.5 grams per cubic centimeter. A core density of this magnitude, in contrast to densities of only about 1.2 grams per cubic centimeter attained with particulate cores, has the advantage of affording a better transmission of the detonation wave and hence a higher detonation velocity for a given diameter. Although the shape of the core's cross-section is not critical to the proper functioning of the cord, it is usually preferred to use a core of substantially circular cross-section to facilitate the production of cords having the circular configuration in common use.

The bonded explosive core is enclosed in sheathing as a means of protecting it against abrasion or other damage that can occur during handling and preparations for blasting. Inasmuch as the sheath is primarily protective, it is relatively thin, i.e., in the range of about from 0.005 to 0.075 inch (0.013 to 0.191 cm), except that a sheath up to about 0.125 inch (0.318 cm) thick may be used if the cord is to be subjected to extremely stressful conditions, as are encountered in surface quarry operations. Uniform protection is difficult to provide with sheaths which are thinner than about 0.005 inch (0.013 cm). A sheath which is thicker than about 0.125 inch (0.318 cm) is not required in the present cord, and, in any event, adds unnecessarily to the thickness and cost of the cord, limits its flexibility, and may be difficult to load into small-diameter boreholes. A sheath thickness of about from 0.020 to 0.050 inch (0.051 to 0.127 cm) is preferred from the point of view of ease of applicability to the core and degree of protection afforded. Thus, with preferred core loadings of 2 to 10 grains per foot and preferred sheath thicknesses of 0.020 to 0.050 inch, the ratio of the core loading (gr/ft) to sheath thickness (in) is 40/1 to 500/1 (3/1 to 39/1 for core loadings of 0.4 to 2 grams per meter and sheath thicknesses of 0.051 to 0.127 cm).

Within the useful sheath thickness range, it often is advisable to use a thicker sheath when the explosive loading in the core is near the low end of the core loading range, inasmuch as in such cases this may assure reliable initiation and propagation of the detonation. Also, as the core explosive loading increases, increasing the sheath thickness may assure a continuity of detonation through knots and half-hitches.

The sheath consists solely of one or more plastic layers. This means that any layer of which the sheath is constructed consists essentially of plastic and that no confining metal or woven textile layer is present in the sheath, either adjacent to or separated from the core.

The sheath is made of a plastic, i.e., deformable, substance that is capable of flowing, e.g., is extrudable, at a temperature not greatly in excess of the melting point of the explosive in the core, i.e., not more than about 75° C. above the explosive's melting point. This allows the plastic sheath to be applied to the core, e.g., by extrusion or other conventional coating procedure, without causing a deleterious transformation of the explosive. The plastic should be flexible and tough when hardened. Although the temperature of the plastic which can be used during the application of the sheath to the core will vary depending on the time of contact between the core and the overlying soft plastic, on the rate of heat exchange between the core and plastic, and on the stability of the binding agent in the core, with a PETN-containing core the plastic should be fluent at a temperature not exceeding about 200° C. The plastic substance can be a thermosetting material such as a rubber or other elastomer, or a thermoplastic material such as wax, asphalt, or one or more polyolefins, e.g., polyethylene or polypropylene; polyesters, e.g., polyethylene terephthalate; polyamides, e.g., nylon; polyvinyl chloride; ionomeric resins, e.g., ethylene/methacrylic acid copolymer metallic salts; etc. Thermoplastic sheaths are preferred, and most preferably polyethylene, on the basis of availability, ease of application, etc.

To enable the cord to retain its structure and dimensions under field use, reinforcement means is used to enhance the tensile strength of the cord and prevent the core from necking down to a failure point under forces normally encountered in borehole loading. While such reinforcement can be provided by a material suspended in the plastic layer(s) of the protective sheath, e.g., by fragments or strands of yarn held therein, for example, in the manner shown in U.S. Pat. No. 2,687,553, or on the outer periphery of the sheath, it is preferred that the core be reinforced by at least one, and usually preferably four or more, continuous strands of yarn which are substantially in contact with the periphery of the core and run substantially parallel to the core's longitudinal axis.

The presence of the yarn strands between the core and the sheath is preferred to yarn strands within the plastic layer of the sheath because heat is less readily transferred from the plastic to the core when hot plastic is extruded onto the core. The term "yarn" is used herein in the sense given in *Standard Definitions of Terms Relating to Textile Materials*, ASTM Designation D 123-74*a*, were "yarn" is defined as a generic term for a continuous strand of textile fibers, filaments, or material occurring as a number of fibers twisted together, a number of filaments laid together without twist, a number of filaments laid together with more or less twist, a single filament (monofilament) with or without twist, or one or more strips made by the lengthwise division of a sheet of material such as a natural or synthetic polymer with or without twist. Varieties of yarn included in this definition are single yarn, plied yarn, cabled yarn, cord, thread, fancy yarn, etc. The strand(s) of yarn are held in place around the core by the plastic sheath, which encloses the core and peripheral strand(s). Any yarn can be used which has a high enough tensile strength as to prevent the core from necking down under forces normally encountered in borehole loading to such a degree that it fails to propagate a detonation. This usually requires that the core be provided with a tensile strength of at least about 10 pounds. For added assurance that the cord will withstand more extreme forces, a tensile strength of at least about 20 pounds in the reinforced core is preferred. The yarn material, filament count, and denier, and the number of yarns, will be selected so as to provide the required tensile strength. Multifilament yarns may be preferred inasmuch as these, in contrast to monofilaments, tend to spread out around the core, providing an insulating effect in the coating operation and a more widespread caging effect. Also, fewer strands and lower deniers can be employed with stronger fibers. Yarns larger than 2000 denier are not preferred, as these add unduly to the thickness of the cord. While any natural fiber can be used in the yarn, synthetic fibers of the polyester, polyamide, and polyacrylic types are preferred on the basis of their superior strength. Especially preferred are nylon, polyethylene terephthalate, and the all-aromatic polyamide made by the condensation of terephthalic acid and paraphenylenediamine. These fibers in deniers of 800 or higher have tensile strengths of at least about 10 pounds and thus a single strand or yarn thereof in the present cord is adequate. Multiple yarns give added strength, however, and therefore are preferred. Also, they can be used in lower deniers, e.g., down to about 400 denier. In the preferred cord, at least four multifilament yarns are spaced substantially uniformly around the core's periphery, resulting in a uniform distribution of reinforcement about the core. There is no significant advantage to be gained by placing multifilament yarns adjacent to one another in the cage prior to the application thereto of the plastic sheath, the cage-drawing and plastic coating operations in any case causing a spreading-out or diffusion of the filaments in multifilament yarns which may cause the yarns to blend around the core. For this reason, and in consideration of the circumference of the core and the denier of the yarns, the use of more than about twelve yarns is superfluous. Usually the layer of filaments will be no thicker than about 0.010 inch (0.025 cm).

Textured and multiplex yarns (as described in U.S. Pat. No. 3,338,764) are especially effective core reinforcing means inasmuch as they can become firmly bonded to the plastic sheath which surrounds them. Application of an adhesive coating, e.g., a soft wax, to the strands also improves the bonding between the strands and plastic sheath, decreasing yarn mobility and possible resulting interference with the core, as well as increasing the peel strength of the sheath.

Figure 2:
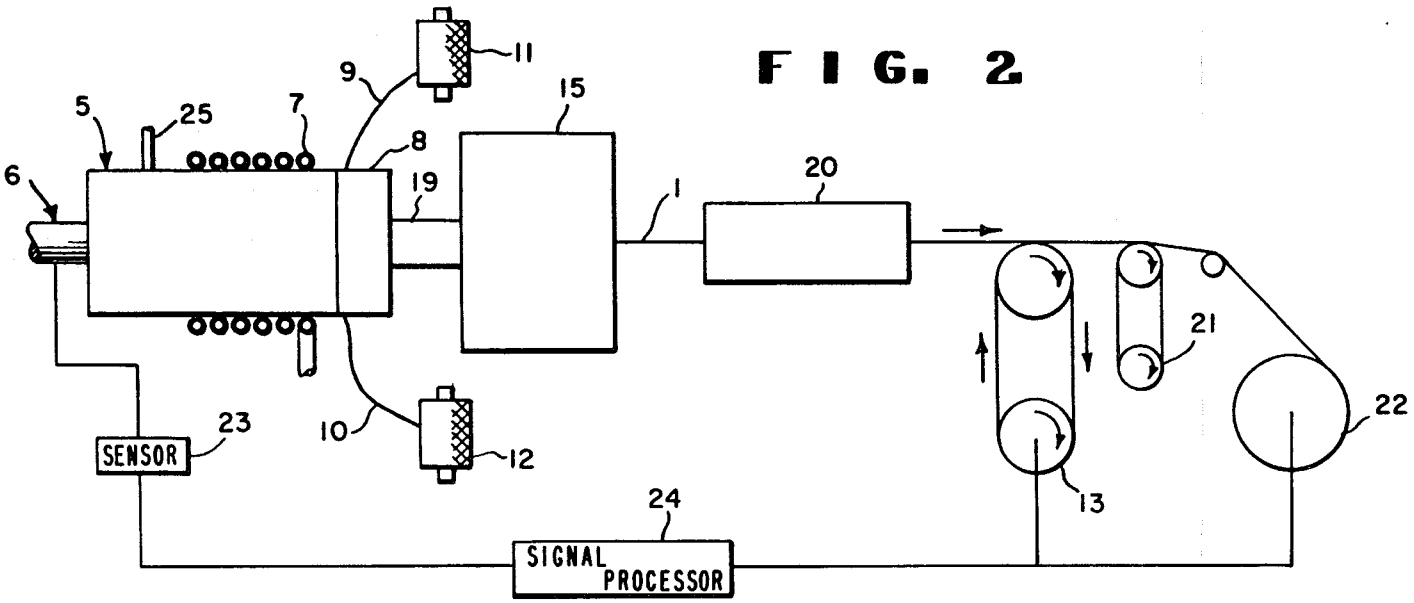
FIG. 2 is a schematic representation of the apparatus of the invention.
Figure 3:
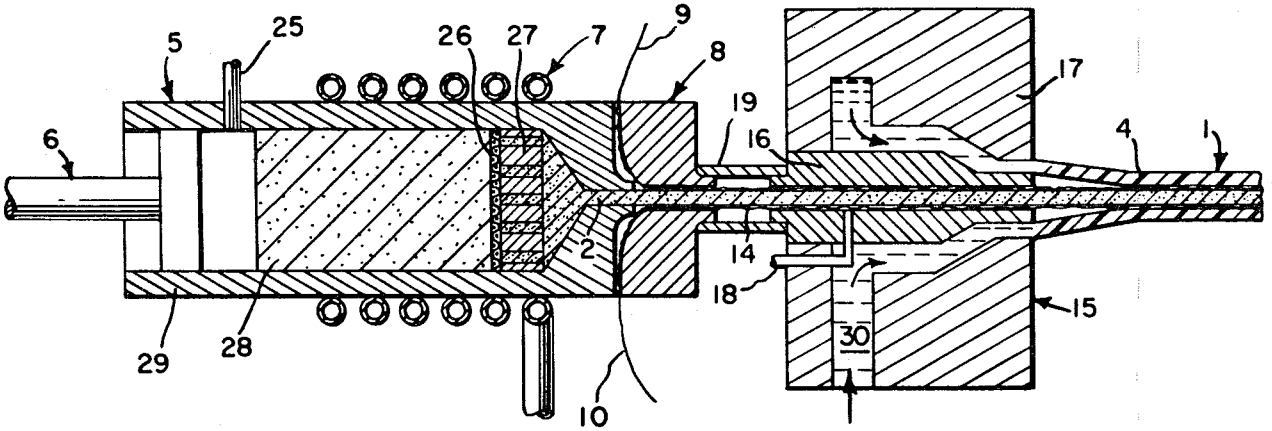
FIGS. 3 and 4 are cross-sectional views of different embodiments of portions of the apparatus shown in FIG. 2.

The process and apparatus of the invention will now be explained with reference to FIGS. 2–4. In FIGS. 2 and 3, 5 is a ram or piston-type extruder having a ram or piston 6, and a cylindrical chamber or barrel 29, which is surrounded by heating coils 7. Extruder chamber 29 is provided with vacuum port 25, and screen 26, which is mounted on one side of a multi-apertured support plate 27. A mass 28 of a deformable bonded detonating explosive composition is shown in extruder chamber 29 and in the apertures of plate 27. Plate 27 has its other side adjacent to the reduced-diameter die portion of chamber 29 into which explosive mass 28 is forced by the action of ram 6 and is shaped into a solid rod or core 2.

Adjacent to the die portion of extruder 5 is strand-orienting plate 8, which is a means for orienting strands of yarn including 9 and 10 into a substantially parallel annular array. Plate 8 has an axial channel, and strand-receiving radial grooves in one surface communicating with the axial channel, the grooved surface of the plate curving as it meets the axial channel. Plate 8 is supported in such a position that its grooved surface meets the surface of extruder 5 so that the plate's axial channel is coaxial with the core 2 emanating from the die portion of extruder 5 by action of ram 6. Strands 9 and 10 are drawn off respective spools 11 and 12 by capstan 13, which constitutes a means for drawing or pulling strands under tension sufficient to form them into a moving cage 14. Core 2 emanating from extruder 5 is entrained within cage 14 and becomes conveyed thereby. Capstan 13 draws cage 14 (containing core 2) through extrusion die 15 of a second extruder, whereby a plastic material is applied around the cage in the form of a sheath 4. Extrusion die 15 has an annular outer portion 17 and an inner tubular member 16, so positioned that a soft plastic material 30 delivered to die 15 through the wall of 17 by known means (not shown) is formed into a tube between facing surfaces of outer portion 17 and inner tubular member 16, and cage 14 moves through the axial channel in tubular member 16. Vacuum port 18 passes through the wall of tubular member 16 and opens into the latter's axial channel. Tubular member 16 and strand-orienting plate 8 are maintained in spaced-apart, coaxial relationship, and are joined together by connecting tube 19, which surrounds cage 14 in the space between plate 8 and tubular member 16.

The sheathed core-containing cage (cord 1) formed at the exit of die 15 moves through vessel 20, e.g., a water tank, which is a means for hardening the plastic sheath material. The cord, after passing over capstan 13, subsequently is collected on windup 22, the winding of the cord being facilitated by its passage over tension-control means 21, e.g., an air dancer. Extruder piston 6 is connected to sensing means 23, which senses the speed of the piston and emits a signal in accordance therewith to signal processor 24, which is connected to the drive means for capstan 13 and to the drive means for windup 22 and adjusts their speeds in accordance with the signal received from sensing means 23.

Figure 4:
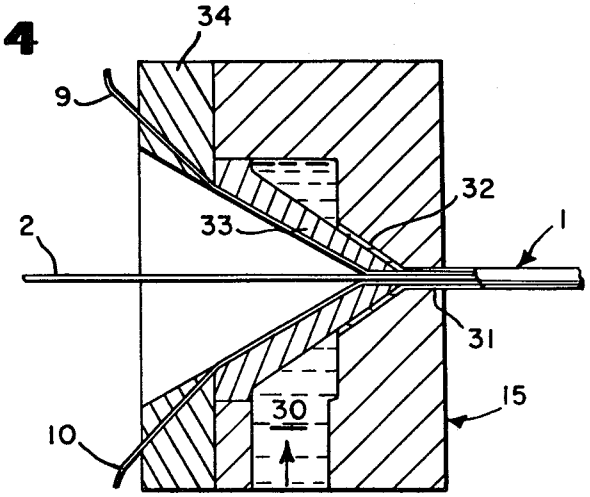

FIG. 4 shows an alternative extrusion die 15 which can be used in the present apparatus in conjunction with an extruder for forming the explosive core. This particular die includes a means for orienting yarn strands into a substantially parallel annular array and thus can be used in the apparatus shown in FIG. 2 without strand-orienting plate 8. In this embodiment an axial channel in extrusion die 15 has a cylindrical portion 31 and a conical portion 32. A hollow conical insert 33 is positioned so that its apex portion is nested within conical die portion 32 with a small spacing between facing surfaces. Capstan 13 draws yarn strands 9 and 10 through apertures in the yarn-guide ring 34, and thence along the inner surface of adjacent conical insert 33. The strands converge in the conical portion of insert 33 and thereafter become oriented substantially parallel to one another and formed into a cage by passage through a cylindrical portion of insert 33.

Explosive core 2 moves into the cylindrical portion of insert 33, where it is entrained by the yarn cage formed therein. Plastic material 30 is introduced into an annulus formed between the walls of conical insert 33 and extrusion die 15. This annulus communicates with cylindrical die portion 31 via the space between conical die portion 32 and the apex portion of insert 33. The cylindrical portion of insert 33 communicates coaxially with cylindrical die portion 31. The core-containing cage 14 formed in the cylindrical portion of insert 33 is drawn through a stream of plastic material 30 which flows through cylindrical die portion 31 having entered there from the space between conical die portion 32 and the apex portion of insert 33. Plastic material 30 is formed into a sheath around caged core 14 to form cord 1.

The preparation of a preferred cord of the invention is illustrated by the following example.

EXAMPLE 1

A. Referring to FIG. 3, mass 28 in extruder chamber 29 is a 1 lb (455-g) slug of a deformable bonded explosive composition consisting of a mixture of 76.5% superfine PETN, 20.2% acetyl tributyl citrate, and 3.3% nitrocellulose prepared by the procedure described in U.S. Pat. No. 2,992,087. The superfine PETN is of the type which contains dispersed microholes prepared by the method described in U.S. Pat. No. 3,754,061, and has an average particle size of less than 15 microns, with all particles smaller than 44 microns. The temperature of chamber 29 is maintained at 63° C. by heating coils 7 to assist in maintaining the extrudability of the explosive composition therein. After the slug of explosive has been placed in chamber 29, ram 6 is advanced to seal off chamber 29, and a vacuum is drawn through port 25. A vacuum level of −29.2 inches of mercury is maintained for 1 minute. This is done to prevent the entrapment of air in the explosive composition, a condition which can cause discontinuities in the extruded core, deleteriously affecting its ability to propagate a detonation. Ram 6 is then advanced further until explosive mass 28 is compressed but not yet to such a degree as to cause extrusion to occur.

Strands 9 and 10, and four additional strands (not shown), are threaded into the radial grooves of plate 8, and are drawn through the axial channels of plate 8 and tubular member 16 by actuating the drive on capstan 13. Each of the six strands is a 1000-denier strand of polyethylene terephthalate yarn, and their tension is controlled at four ounces (each) by tension-control means 21. At the same time the drive on windup 22 and the means for moving plastic material 30 are actuated. Plastic material 30 is low-density polyethylene at a temperature of 150° C. Vessel 20 is a two-compartment trough containing water at 81° C. in the first compartment through which the cord passes, and water at 21° C. in the second compartment. This two-zone cooling assists in providing a more uniform cooling of the plastic sheath and promoting a tighter fit of the sheath on the cage. The diameter of the portion of extruder 5 wherein core 2 is formed is 0.030 in (0.076 cm). The spacing between the facing surfaces of outer portion 17 and inner tubular member 16 of die 15 is such as to produce a polyethylene sheath 4 having a thickness of 0.035 in (0.089 cm).

After capstan 13, tension-control means 21, windup 22, and vessel 20 are operating, ram 6 is advanced at a rate of 0.500 in (1.270 cm) per minute. Explosive mass 28 is forced through screen 26, which screens out particles larger than 0.010 inch, and through the apertures in plate 27, and is formed into solid core 2 having a 0.030 in (0.076 cm) diameter. The core moves out of extruder 5 at a rate of 248 feet per minute, and the speed of the cage being advanced by capstan 13 and wound on windup 22 is matched to the core extrusion rate by signals received from signal processor 24. A vacuum is drawn through port 18 to assist in collapsing the plastic sheath onto the core-containing cage 14 passing through tubular member 16. A vacuum level of −5.9 inches of mercury is maintained in tubular member 16.

Figure 1:
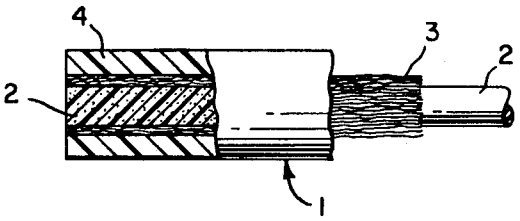
FIGS. 1 and 5 are perspective views in partial longitudinal cross-section of sections of different embodiments of the connecting cord of the invention.

Cord 1 accumulated on windup 22 has an outer diameter of 0.100-in (0.254 cm), a 0.030-in (0.076-cm) diameter core, and a 0.035-in (0.089-cm)-thick polyethylene coating. The PETN loading in the core is 2.5 grains per foot (0.533 g/m) (gr/ft PETN per in. coating=71/1; g/m PETN per cm coating=6/1), and the core density is 1.5 grams per cubic centimeter. The filaments of the yarns surround the core substantially completely as shown in FIG. 1. The core is flexible and light, and has a tensile strength of 100 pounds (45 kilograms).

The cord, initiated by a No. 6 blasting cap, the end of which is in coaxial abutment with the exposed end of the cord, detonates at a velocity of 6900 meters per second. The cord does not initiate itself from one section spliced together side-by side with another. Detonation of a continuous length of the cord is propagated through knots of various types. Also, the cord is difficult to initiate if the cap-to-cord abutment is not coaxial.

B. The same cord is made by the procedure described in Section A above, except that extrusion die 15 shown in FIG. 4 replaces die 15 and strand-orienting plate 8 shown in FIG. 3. In this procedure, capstan 13 draws four strands of yarn through the cylindrical portion of insert 33 under tension sufficient to form them into a moving cage of longitudinal substantially parallel strands; the cage entrains the core; and the core-containing cage is drawn through the stream of polyethylene flowing through the cylindrical portion of the die's axial channel whereby a sheath of soft polyethylene is applied around the cage. As in the procedure described in Section A, substantially no reduction in the diameter of the core occurs during the operation.

Cords having different core diameters, sheath thicknesses, and numbers of reinforcing yarns strands can be produced by the procedures described above by suitable modification of die sizes and extrusion rates.

The use of the low-energy detonating cord of the invention, and the effects of various parameters such as core loading and diameter, sheath thickness and composition, and number and type of reinforcing yarns, are shown by the following examples.

EXAMPLE 2

Four grains (0.26 g) of the superfine PETN described in Example 1 is placed in a 0.003-in (0.08-mm)-thick coined bottom aluminum shell, the end of which is butted against the side of a 10-foot (3-meter) length of the cord described in Example 1A, with the exception that the cord in this case has a 0.050-in-(0.127-cm) diameter core having a PETN loading of 7 gr/ft (1.49 g/m). This cord serves as a trunkline. One end of a 5-foot (1.5-meter) length of the cord described in Example 1A (downline) is inserted into the aluminum shell (the booster) so as to contact the PETN. The other end of the downline is butted with its side against the percussion-sensitive element of a percussion-type delay cap. The trunkline is detonated by means of a No. 6 blasting cap having its end in coaxial abutment with the exposed end of the cord. The detonation is transmitted from the trunkline to the booster, from the booster to the downline, and from the downline to the percussion-type delay cap.

The same results are obtained with trunkline cords having 10 gr/ft (2.13 g/m) and 4.4 gr/ft (0.938 g/m), i.e., 0.060-in- (0.152-cm) and 0.040-in- (0.102-cm) diameter, cores; and with downline cords having 3.0 gr/ft (0.638 g/m) and 2.2 gr/ft (0.469 g/m), i.e., 0.033-in- (0.084-cm) and 0.028-in- (0.07-cm) diameter, cores.

EXAMPLE 3

The following tests show the kinds of abusive treatment with respect to knotting, tension, and abrasion the cord of this invention is capable of withstanding.

A. One end of a 60-foot (18-meters)-long downline of the cord described in Example 1A is butted with its side against the percussion-sensitive element of a percussion-type delay cap. The cap is embedded in a 2-pound (0.9 kg) chub cartridge (flexible flim tube having constricted sealed ends), 2 inches (5 cm) in diameter and 16 inches (41 cm) in length, containing a nonexplosive composition simulating a water gel explosive. The cap and cord are secured in position in the film cartridge by two half hitches. The cartridge is lowered into a simulated 50-foot (15-meter)-deep borehole under various loading conditions which could be encountered in field use, the simulated hole being the inside of a vertical 5-inch (13-cm)-diameter steel pipe. The other end of the 2.5 gr/ft downline is connected to the booster and 7 gr/ft trunkline as described in Example 2. After the pipe has been loaded under the described conditions, the trunkline is detonated as described in Example 2. The downline detonates completely, and the percussion-sensitive delay cap detonates within its designed timing, after the downline-cap-cartridge assembly has been subjected to the following loading conditions:

I. The cartridge is allowed to fall freely for the entire length of the downline.

II. The free fall of the cartridge is stopped suddenly every 15 feet (4.6 m).

III. The cord moves against the rough edge of the steel pipe as the assembly is lowered into the pipe.

IV. Conditions II and III are combined.

V. A 7-pound (3.2 kg) sand bag is dropped into the pipe, removed and dropped again for a total of five times, onto the assembly positioned in the pipe in each of cases I, II, III, and IV, the sand bag scraping against the cord in its fall.

B. A knot is tied in the cord described in Example 1A, and a 7-pound (3.2 kg) weight is suspended from the end of the cord. The weight is dropped into the 50-foot pipe described in Part A above, while the free fall of the weight is stopped 5 times, thereby exerting increased tension on the knot. Five cords handled in this manner subsequently detonate completely, with no cut-offs at the knots.

EXAMPLE 4

The use of the cords described in Examples 1 and 2 to transmit detonation waves to the bottom charge of a column of blasting explosive charges in boreholes is as follows:

Six 25-foot (7.6-meter)-deep, 3-inch (7.6-cm)-diameter boreholes spaced 8 feet (2.4 meters) apart are each loaded with three aligned 2×16 inch (5×41 cm) chub cartridges of a water gel explosive described in U.S. Pat. No. 3,431,155, wrapped in polyethylene terephthalate film. Embedded in the bottom cartridge in each hole is a percussion-type delay cap, connected to the cord (downline) described in Example 1B in the manner described in Example 2. The other end of each downline is connected to the trunkline cord described in Example 2 (except having four yarn strands) in the manner described in Example 2. No stemming is used. Detonation of the trunkline results in sequential detonation of the charges in the holes starting with the bottom charge, as concluded from the delay timing of the caps used. There is no evidence of column disruption.

EXAMPLES 5–10

Cords are made as described in Example 1. The core explosive composition is 76.1% superfine PETN, 20.3% acetyl tributyl citrate, and 3.6% nitrocellulose (by weight). Four strands of the same yarn as that described in Example 1 are used. The same plastic coating composition. as that described in Example 1 is used. The core is extruded to different diameters, and coatings of different thicknesses are applied. The detonation properties of the cords (initiated as described in Example 1) are summarized in the following table:

| Ex. | Core Diam. in.(cm.) | PETN gr./ft. (g./m.) | Detonation Velocity (m./sec.) at Cord O.D.* Specified 0.070 (0.178) | 0.080 (0.203) | 0.090 (0.229) | 0.100 (0.254) | 0.125 (0.318) |
|---|---|---|---|---|---|---|---|
| 5 | 0.013(0.033)[a] | 0.5(0.107) | | | | 6600 | |
| 6 | 0.020(0.051) | 1.0(0.213) | | 6700 | 6600 | 6600 | |
| 7 | 0.030(0.076) | 2.5(0.533) | 6800 | 6800 | 6600 | 6700 | 6700 |
| 8 | 0.040(0.102) | 4.4(0.938) | 6800 | 6800 | | 6800 | 7200 |
| 9 | 0.050(0.127) | 7.0(1.49) | | | | 7000 | |
| 10 | 0.060(0.152) | 10.0(2.13) | | | | 7000 | |

[a]This cord is initiated and propagates a detonation in 50% of the trials made; all other cords detonate reliably.

*Outer diameter in inches (cm).

These examples show that the detonation velocity of the cords tested is within the 6900 meters per second ±5% range regardless of the PETN loading and the thickness of the plastic coating. With this particular core composition and a coating thickness of 0.044 inch (0.112 cm), however, reliability of detonation becomes compromised somewhat at the minimum PETN loading and core diameter.

EXAMPLES 11–14

The explosive cord described in Examples 5–10 is tested in three different core loadings and diameters for reliability of initiation and continued propagation with minimum coating thicknesses.

| Ex. | PETN gr./ft. (g./m.) | Core Diam. in.(cm.) | No. of Detonations Out of 10 Trials at Coating Thickness* Specified 0 | 0.010 (0.025) | 0.015 (0.038) | 0.025 (0.064) |
|---|---|---|---|---|---|---|
| 11 | 0.5(0.107) | 0.013(0.033) | 0 | | | 10 |
| 12 | 1.0(0.213) | 0.020(0.051) | 4 | | 10 | |
| 13 | 2.5(0.533) | 0.030(0.076) | 8 | 10 | | |

-continued

| Ex. | PETN gr./ft. (g./m.) | Core Diam. in.(cm.) | No. of Detonations Out of 10 Trials at Coating Thickness* Specified 0 | 0.010 (0.025) | 0.015 (0.038) | 0.025 (0.064) |
|---|---|---|---|---|---|---|
| 14 | 7.0(1.49) | 0.050(0.127) | 10 | | | |

*in.(cm.)

These examples show that as the core diameter and PETN loading increase, the plastic coating has a diminishing effect on the cord's ability to be initiated and propagate a detonation.

EXAMPLE 15

The cord described in Examples 5–10 having a 0.030 in. (0.076 cm) core is made with different coating materials and thicknesses. All samples (at least 150 feet (46 m) in length) of the cord with 0.020-in. (0.051-cm), 0.028-in. (0.071-cm), and 0.033-in. (0.084-cm)-thick coatings of low-density polyethylene, high-density polyethylene, and a metallic salt of a copolymer of ethylene and methacrylic acid (an ionomeric resin) detonate reliably at a velocity of about 7200 meters per second with four strands as well as eight strands of the yarn. The extrusion die temperature is 175° C. for applying the high-density polyethylene, and 135° C. for applying the ionomeric resin.

The minimum tensile strength is 70 lbs (32 kg) for all samples made with 4 strands of the yarn, and 140 lbs (64 kg) for all samples made with 8 strands of the yarn. All samples, regardless of coating material thickness and type, detonate after the following treatment: A 6-lb (2.7 kg) weight is tied to one end of the cord. The weight is allowed to drag the cord by gravity over the edge of a concrete block, and then the cord is dragged back to its starting point. This procedure is repeated five times.

EXAMPLES 16–19

The effect of core loading and sheath coating thickness on the behavior of the cord described in Examples 5–10 when knotted, as may occur in field use, is shown in the following table:

| Ex. | PETN gr./ft. (g./m.) | Core Diam. in.(cm.) | Coating Thickness in.(cm.) | Times Detonation Propagates Through Knots: Half-Hitch | Knot |
|---|---|---|---|---|---|
| 16 | 2.5(0.533) | 0.030(0.076) | 0.035(0.089) | 15[a] | 5[b] |
| 17 | 3.0(0.638) | 0.033(0.084) | 0.034(0.086) | 15[a] | 5[b] |
| 18 | 3.4(0.723) | 0.035(0.089) | 0.033(0.084) | 13[a] | 2[b] |

-continued

| Ex. | PETN gr./ft. (g./m.) | Core Diam. in.(cm.) | Coating Thickness in.(cm.) | Times Detonation Propagates Through Knots Half-Hitch | Knot |
|---|---|---|---|---|---|
| 19 | 4.4(0.853) | 0.040(0.102) | 0.043(0.109) | 14[a] | 4[b] |

[a]Out of 15 trials
[b]Knot tied under 10-lbs. tension; out of 5 trials

These examples show that the specified cords propagate a detonation through knots rather than cut-off at the knots owing to excessive brisance. They also show that as the explosive loading is increased an increase in the sheath thickness will assure the propagation of detonation through knots.

EXAMPLES 20–24

The cord described in Examples 5–10 having a 0.030 in. (0.076 cm.)-diameter core is made with different numbers of multi-filament strands of polyethylene terephthalate (PET) yarn and an aramide yarn made from the condensation polymer of terephthalic acid and paraphenylenediamine (all 1000 denier per strand). The effect of these variables on cord strength and the cord's ability to propagate a detonation through knots is shown in the following table:

| Ex. | PET Yarn No. of Strands | Aramide Yarn No. of Strands | Tensile Strength of Cord lb.(kg.) | Times Detonation Propagates Through Knots Half-Hitch | Knot |
|---|---|---|---|---|---|
| 20 | 2 | | 43(20) | 4[a] | 2,0,0,0[b] |
| 21 | 4 | | 82(37) | 10[a] | 3,0,0,0[b] |
| 22 | 8 | | 150(68) | 10[a] | 3,3,3,0[b] |
| 23 | | 2 | 105(48) | 9[a] | 2,1,0,0[b] |
| 24 | | 4 | 198(90) | 10[a] | 3,3,3,3[b] |

[a]Out of 10 trials
[b]Knots tied under 10,20,30, and 40 lbs.
(4.5,9.1,13.6, and 18.2 kg) tension, respectively; out of 3 trials each These examples show that the tensile strength of the cord for a given number of yarn strands of the same denier varies with the tensile strength of the yarn. In this case, the aramide provides a higher tensile strength cord with fewer strands than the polyester. The examples also show that a larger number of strands of a given fiber, or a stronger fiber, will increase the cord's ability to propagate a detonation through tighter knots.

EXAMPLE 25

A continuous solid core of a bonded explosive composition consisting of (by weight) 75% superfine PETN and 25% of a binding agent consisting of a butadiene, acrylonitrile, methacrylic acid copolymer (described in the aforementioned U.S. Pat. No. 3,338,764) is attached to a single strand of aramide yarn made from the condensation polymer of terephthalic acid and paraphenylenediamine. The core and supporting strand are dragged together through a tubular coating die, which applies a 0.025-in. (0.064-cm.)-thick sheath of low-density polyethylene around them. The resulting cord, which has a PETN loading of 7 grains per foot, detonates at about 7000 meters per second when initiated by the procedure described in Example 1, and has a tensile strength of about 75 pounds (34 kg.).

EXAMPLE 26

The deformable bonded explosive composition described in Example 1 (except that the superfine PETN content is 76 percent, acetyl tributyl citrate twenty percent, and nitrocellulose 4 percent) is extruded so as to form ten 4-foot (1.2-meter)-long cords, five having a 0.030-inch (0.076-cm) diameter (2.5 gr/ft or 0.533 g/m PETN) and five having a 0.050-inch (0.127-cm) diameter (7.0 gr/ft or 1.49 g/m PETN). The extruded cords are slipped into low-density polyethylene tubing having an inner diameter of 0.060 in. (0.152 cm) and an outer diameter of 0.080 in. (0.20 cm). The ratios of explosive loading to wall thickness of these cords are 250/1 and 700/1, respectively, in gr/ft loadings and thicknesses in inches (18/1 and 50/1, respectively, in g/m loadings and thicknesses in cm). All of the cords have tensile strength of about 10 pounds (4.5 kilograms).

The cords are initiated by a No. 6 blasting cap, the end of the cord being in coaxial abutment with the exposed end of the cord. All of the cords detonate without cut-offs, consuming all of the plastic coating. The average detonation velocity for all ten cords is 7300 meters per second.

In the process of this invention substantially no reduction is effected in the core diameter after the core has been formed. The process produces a high-density core without requiring a reduction in the diameter of the core as is required, for example, in processes for making cords having a particulate explosive core. Elimination of a change of core diameter during the process simplifies process control with respect to achieving a required final core explosive loading and avoids the possible penetration of the core by the surrounding yarn strands.

In detonating cords having small-diameter, low-loading cores, the presence of particles of foreign matter, e.g., sand, metal, etc., may interfere with the detonation of the cord if the particle are large enough. For this reason, an important feature of the present process is the provision of a core explosive composition exempt of such particles by virtue of the procedures and conditions employed in its preparation, or the presence of particle-screening means in the extruder used for making the core. For cores having diameters of about 0.030 in. (0.076 cm) and larger, particles larger than about 33% of the core diameter should be excluded. For smaller-diameter cores, particles larger than about 0.005 in. (0.013 cm) should be excluded.

In the present method when strands of yarn and the explosive core move separately into a plastic coating extrusion die, the cage formed therein usually will entrain the core and the sheath will subsequently be formed on the caged core unit. However, the cage-formation, core-entrainment, and sheathing may occur substantially simultaneously. Also, the two extrusion means of the apparatus, i.e., the core-forming die and the sheath-forming die, may be components of separate extruders, or may be positioned together in a single co-extrusion unit.

I claim:

1. A method of producing a detonating cord comprising (a) forming a mixture of cap-sensitive crystalline high explosive compound and a binding agent therefor into a continuous solid core;

(b) drawing strands of yarn under tension sufficient to form a moving cage of substantially parallel longitudinal strands;

(c) allowing said moving cage to entrain said core within it, whereby said cage becomes a conveyor for said core;

(d) applying a layer of soft plastic material around said moving cage while effecting substantially no change in the diameter of said core after its entrainment within said cage; and (e) hardening the plastic material.

2. A method of claim 1 wherein said core is extruded into said moving yarn cage, and said caged core unit subsequently passes into and through an extrusion die wherein said plastic material is formed into a sheath over said caged core unit.

3. A method of claim 2 wherein said die is a tubular die and the plastic tube formed therein is collapsed onto said caged core unit by the drawing of a vacuum through said die.

4. A method of claim 1 wherein said strands of yarn and said core are moved separately into an extrusion die wherein said strands are formed into said cage and entrain said core, and said plastic sheath forms around said caged core unit by passage of said caged core unit through a stream of plastic.

5. A method of claim 1 wherein said mixture is formed into said solid core under vacuum.

6. A method of claim 1 wherein said mixture is treated so as to exclude from the core particles larger than about 25% of the core diameter.

7. Apparatus for producing a detonating cord comprising (a) a first extrusion means, for forming a mass of a deformable bonded detonating explosive composition into a continuous solid core;

(b) means for orienting strands of yarn substantially parallel to one another in annular array;

(c) means for drawing said substantially parallel strands under tension sufficient to form them into a moving cage, said strand-orienting means being so positioned with respect to said first extrusion means that said cage internally entrains and conveys said core emanating from said first extrusion means;

(d) a second extrusion means, for applying a soft plastic material in the form of a sheath to a substrate moving therethrough, said second extrusion means being so positioned with respect to said first extrusion means and said strand-orienting and strand-drawing means that the caged core is drawn through said second extrusion means by said strand-drawing means so as to constitute the substrate for the sheath application with substantially no previous, coincident, or subsequent reduction in core diameter; and (e) means adapted to receive the passage of the thus-drawn sheathed, caged core for hardening said plastic material.

8. Apparatus of claim 7 wherein said first extrusion means is associated with an extruder chamber which contains an opening for the drawing of a vacuum.

9. Apparatus of claim 7 wherein said first extrusion means is associated with an extruder chamber which contains particle-screening means for excluding particles larger than about 25% of the core diameter from the core.

10. Apparatus of claim 7 wherein said first extrusion means is associated with a ram extruder provided with a heated chamber.

11. Apparatus of claim 7 including means associated with said first extrusion means and with said strand-drawing means, adapted to sense the output of said first extrusion means and adjust the speed of said strand-drawing means accordingly.

* * * * *